United States Patent [19]

Parrish

[11] 4,228,734

[45] Oct. 21, 1980

[54] METAL CAN CRUSHER

[76] Inventor: Ernest H. Parrish, 313 Coral Hills, El Paso, Tex. 79912

[21] Appl. No.: 27,902

[22] Filed: Apr. 5, 1979

[51] Int. Cl.[3] ..... B30B 9/32

[52] U.S. Cl. ..... 100/245; 100/DIG. 2; 100/257; 100/293

[58] Field of Search ..... 100/DIG. 2, 245, 257, 100/293; D15/123

[56] References Cited

U.S. PATENT DOCUMENTS

| | | | |
|---|---|---|---|
| 2,563,379 | 8/1951 | Smith | 100/DIG. 2 |
| 2,603,270 | 7/1952 | Voigt | 100/DIG. 2 |
| 2,603,271 | 7/1952 | Heymers | 100/DIG. 2 |
| 2,638,957 | 5/1953 | Danielson | 100/DIG. 2 |
| 3,009,414 | 11/1961 | Griemert | 100/DIG. 2 |
| 3,411,722 | 11/1968 | Webber | 100/DIG. 2 |
| 3,732,804 | 5/1973 | Moller | 100/DIG. 2 |
| 3,889,587 | 6/1975 | Wharton | 100/DIG. 2 |
| 4,062,283 | 12/1977 | Kaminski | 100/DIG. 2 |
| 4,133,261 | 1/1979 | Belfils | 100/DIG. 2 |

*Primary Examiner*—Billy J. Wilhite

*Attorney, Agent, or Firm*—Clarence A. O'Brien; Harvey B. Jacobson

[57] ABSTRACT

A device for axially crushing a can is disclosed. The device is hand operated and characterized by a mechanical linkage which increases the mechanical advantage or leverage applied to the can undergoing crushing, giving an ultimate result of compression of recyclable cans, particularly aluminum cans, to a small fraction of their original size. Also disclosed is a method of operation of the device.

6 Claims, 4 Drawing Figures

METAL CAN CRUSHER

BACKGROUND OF THE INVENTION

Field of the Invention

The invention relates to a manually actuable food or beverage can crushing device, particularly for compressing beverage aluminum cans to a small fraction of their original size to promote safe and efficient collection and recycling thereof.

Disclosure Statement

U.S. Pat. No. 2,563,379, issued Aug. 7, 1951 to H. H. Smith, discloses a can crushing device having a stationary anvil against which a can is crushed by downward force of an operating handle, which acts through a link to push downwardly a vertically movable anvil against the can. B. W. Moller in U.S. Pat. No. 3,732,804, issued May 15, 1973, discloses a method and apparatus for flattening thin metal cans, and C. Webber in U.S. Pat. No. 3,411,722, issued Nov. 19, 1968, shows a crusher device for crushing or breaking empty cans and bottles.

Other U.S. Pat. Nos. relating to can crushers include the following:

2,603,270, H. L. Voigt et al, July 15, 1952
3,009,414, K. H. Griemert, Nov. 21, 1961
3,889,587, F. E. Wharton, June 17, 1975.

A substantial need exists for a device having a linkage arrangement and guide structure which is adaptable for use at a point of generation of empty aluminum beverage cans and is operable with minimum effort by personnel, such as busboys, waitresses, and the like, in eating or drinking establishments. Specifically, with the recently recognized importance of recycling of aluminum cans for the purpose of conserving energy required for producing new aluminum metal, the need for a portable device having no electric parts, but manually operable by virtually any person, has come to recognized as important.

SUMMARY OF THE INVENTION

The present invention discloses a device and method for meeting the need for conservation and recycling of valuable aluminum metal in empty aluminum beverage cans by providing a device which crushes such a can, utilizing a variable mechanical advantage for exerting increasing force on the can undergoing axial compression, ultimately to a flattened configuration which is only a fraction of its original length.

Accordingly, it is a principal object of the invention to provide a manually operated metal can crusher which increases the mechanical advantage attainable during axial compression of a metal can to a fraction of its original length.

Another object is to provide a metal can crusher which is portable and can be used at various locations where empty aluminum beverage cans are generated in quantity.

Still another object is to provide a method and device for crushing aluminum cans which saves energy by avoiding use of electric parts, thereby reducing the cost of manufacture and operation.

Yet another object is to provide a simple, sturdy device having no more than three moving parts and requiring only minimal maintenance.

A further object is to enable reclaimed crushed metal cans to be stored in a smaller volume, thereby reducing the space requirements for storage, as well as the number or size of containers, such as plastic bags, required for storage of recovered empty cans.

Another further object is to promote litter control by promoting collection of empty beverage containers which would otherwise be disposed of in public or private locations and thereby create a litter problem.

Still another further object is to enable operators of establishments which produce empty beverage containers in quantity, or operators of refuse collection agencies, to recover a portion of costs of operation by promoting efficiency of collection of metal beverage containers with use of the method and device of the present invention.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

As is well known in the art, commercial establishments, such as restaurants, taverns, filling stations, as well as households, and the like, have been plagued with a trash and litter control problem and attendant disposal costs and expense. Although there have been continuing efforts to reduce the volume occupied by empty beverage and other cans for efficient disposal or salvage, such as cutting the circular top and bottom and flattening of the walls, such techniques are not easily adapted to seamless cans, such as aluminum beverage cans introduced within the last decade, and such aluminum cans do not undergo natural processes of degradation in the environment, such as occurs with steel-based metal cans under ordinary conditions of rusting or weathering. Accordingly, a severe environmental problem has been created by widespread use of such cans. Moreover, the energy required for manufacture of aluminum has come to be recognized as substantial, and is now regarded as important to be recovered.

With use of the device of the present invention, operated according to the method taught by the present invention, empty aluminum or other metal cans are easily compressed by a single operator without use of costly electrical equipment and power, the axial compressions generating a flattened recyclable object having marketable value to the aluminum processing industry.

Figure 1:
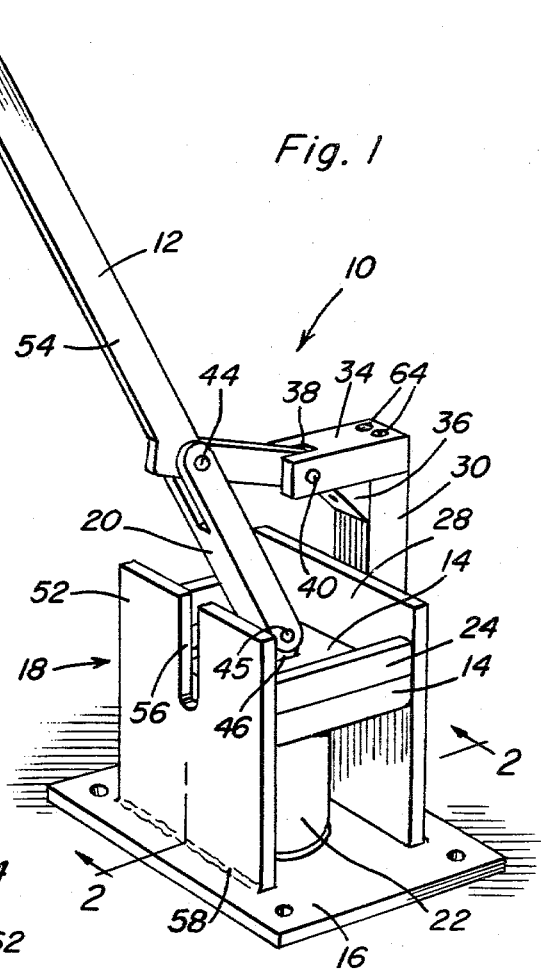
FIG. 1 is a perspective view of the metal can crusher of the present invention in a position of operation immediately before the operation of axially crushing an inserted metal can is begun.

In FIG. 1, can crusher 10 is made of mallet 12, movable anvil 14, base plate 16, box assembly 18, and toggle 20. Metal can 22 is inserted through the open side of box assembly 18, which can be enclosed on three sides for safety reasons.

Figure 4:
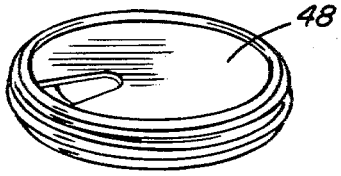
FIG. 4 is a perspective view of a typical can after crushing by the method and device of the present invention.
Figure 2:
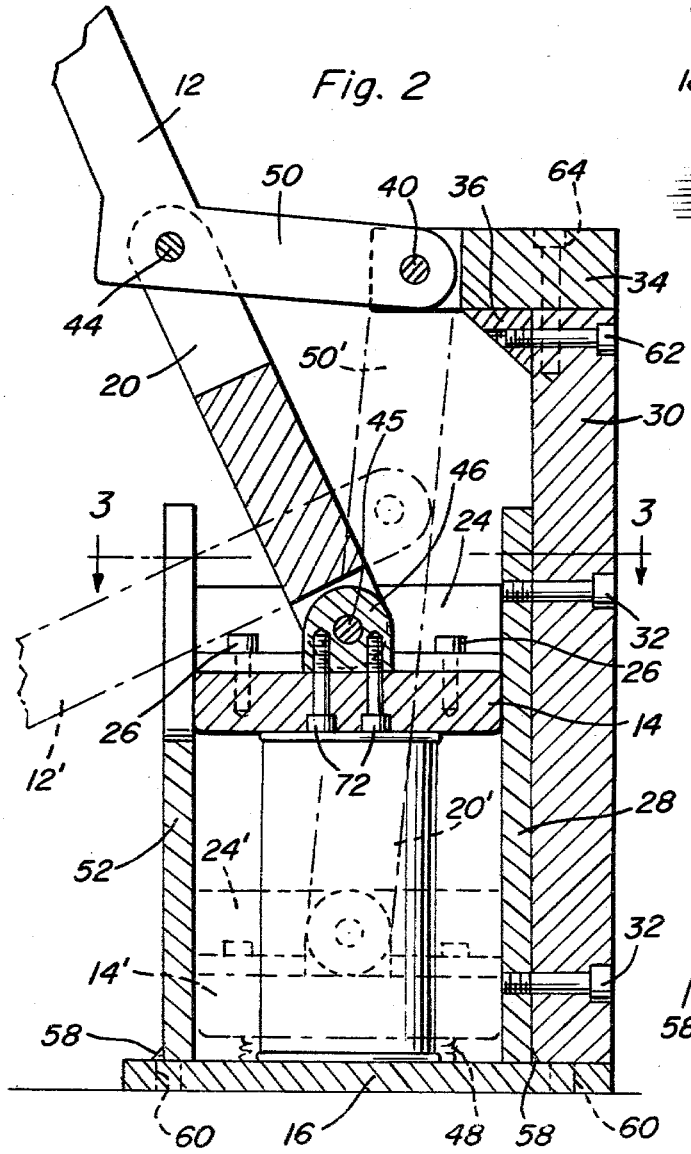
FIG. 2 is a vertical sectional view taken substantially upon a plane passing along section line 2—2 on FIG. 1, showing the device in the same configuration in FIG. 1, as well as (in phantom) the device in the configuration in which the can has been crushed to a small fraction of its original length.

Movable anvil 14 is provided with guides 24, which are bolted thereto by machine bolts 26. Box assembly 18 is made up of side wall 28, to which post 30 is bolted by bolts 32. Post 30 supports arm 34, assisted by gusset 36. Arm 34 is provided with slot 38 for pivotally receiving mallet 12, which is free to rotate about post pivot pin 40. Upon manual pivoting of mallet 12 downwardly, toggle 20 is guidingly forced downwardly by pivoting about center post 44, and transmits such downward force through anvil pivot pins 45 and lug 46 to movable anvil 14. Such action is best seen in FIG. 2 where the result of the downward stroke of mallet 12 can be seen in vertical movement of anvil 14 from the initial shown in FIG. 1 and in FIG. 2 in solid lines to the final position in which can 22 has been crushed to the configuration of FIG. 4, shown in dotted lines in FIG. 2. In such position, can 22 has been converted into crushed configuration 48, which represents a fraction of the height or length of can 22.

It is apparent from FIG. 2 that in the initial stages of crushing of can 22, shank 50 of mallet 12 is approximately at right angles to toggle 20, while in the later stages of crushing, shank 50′ is approximately in alignment with toggle 20′. Accordingly, the mechanical advantage or leverage obtainable is relatively greater in the later stages of compression, inasmuch as the vertical movement of anvil 14′ per unit of angular excursion of mallet 12 is less at such stage than is the case during initial compression, when the vertical movement of anvil 14 is relatively great per unit excursion of mallet 12. Inasmuch as the requirements for axial force in achieving crushing or compression of a metal can are greater during the latter stages of compression, crusher 10 of the present invention offers clear and decided advantages over mechanical crushers which exert approximately the same or diminishing mechanical advantage during the latter stages of compression. Consequently, crusher 10 can be used in a manner which does not require application of an extraordinary degree of manual exertion, and yet which produces a final crushed configuration 48 which is only a small fraction of the original height of can 22.

Box 18 is made up of side wall 28, as well as slotted side wall 52. Handle portion 54 of mallet 12 is free to slide within slot 56 of wall 52 when the stroke of mallet 12 traverses its lower reach. Walls 28 and 52 are welded or otherwise attached to base plate 16, such as at weldments 58.

Base plate 16 is provided with mounting holes 60 for mounting on any convenient flat surface, such as, for example, a table, barrel, bar, or the like. Gusset 36 is mounted on post 30 by any convenient means, such as by bolt 62, and arm 34 is mounted on post 30 by bolts 64, which are staggered to avoid interference with bolt 62.

Figure 3:
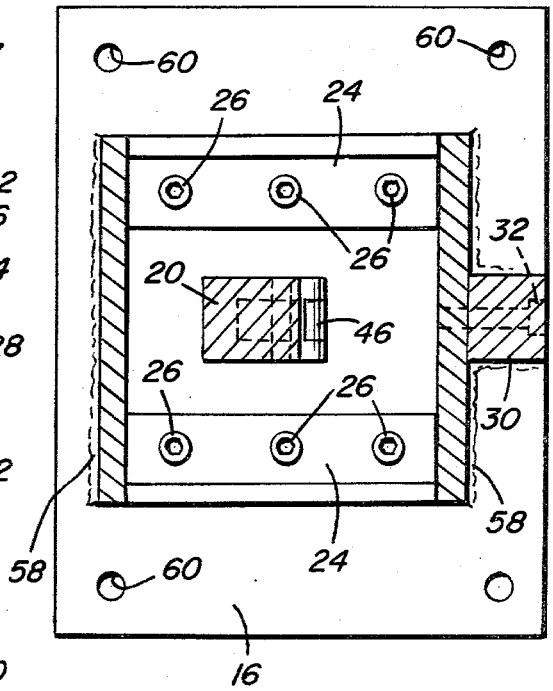
FIG. 3 is a horizontal sectional view, taken substantially upon a plane passing along section line 3—3 on FIG. 2, showing the anvil and associated guides.

An important feature of operation of can crusher 10 derives from the operation of anvil 14 from a center point above box 18 in which can 22 is placed as shown in FIGS. 2 and 3. This center point, on which anvil pivot pin 45 is located linking lug 46 with toggle 20, enables a snap be developed during the stroke of mallet 12. This snap occurs as the result of two specific movements possible from relative motion of the three pivot points represented by pins 40, 44 and 45. The snap develops as the one movement blends into the other occurring upon reversal of direction of anvil 14. With mallet 12 in upraised position shown in FIGS. 1 and 2, and during the initial downward traverse of mallet 12, these three points defined by pins 40, 44 and 45 describe an acute triangle. During downward traverse of mallet 12, the mechanical advantage generated increases in the manner described hereinabove and the triangle becomes obtuse as pin 44 describes a segment of a circular arc centered on pin 40 and the angle formed by shank 50 and toggle 20 increases. Finally, when the three pivot pins reach a collinear configuration, as is shown in dotted lines in FIG. 2, anvil 14 has reached its lowermost extension, and further downward movement of mallet 12 starts a slight uplifting of anvil 14. These two distinct movements give rise to the snap which is observed by an operator of the device, and insures that maximum leverage is exerted in the lowermost position, where the need for compressive strength is greatest. As is readily apparent from FIG. 2, lug 46 can be changed by removing bolts 72 and replacing lug 46 with another wherein pin 45 is located a greater distance above anvil 14, giving a maximum downward path of travel of anvil 14 slightly lower and usable for a somewhat smaller can than can 22. On the other hand, lug 46 can be replaced by another having pin 45 somewhat closer to anvil 14, thereby insuring that the downward travel of anvil 14 is somewhat higher above base plate 16, thereby adapting device 10 for use with somewhat larger cans. Alternatively, the user can determine at what size he wishes the can to be crushed. The maximum downward travel of anvil 14 is, of course, the position at which the snap occurs, where maximum leverage will take place and where the final configuration 48 of can 22 will be produced.

A further distinct advantage of the invention resides in the fact that user safety is promoted by the construction of the present invention with the center of operation at pin 40 above the box assembly 18. Although not shown in the drawings, it is possible to provide a third side of box assembly 18 to reduce further the possibility of injury to the user, and even a fourth side or door can be added to cover the area where the can enters and exits to even further reduce the possibility of escape of fragments during crushing operations.

Box 18 is preferably molded of aluminum, thereby eliminating a corrosion problem present with use of steel or other corrodible metals of construction. Further, eliminating corrosion minimizes health hazards associated therewith, particularly when crusher 10 is to be installed or operated in a typical eating or drinking establishment.

Preferably, crusher 10 is constructed in a weight and size specifically chosen to reduce space requirements and retain strength adequate for the purpose intended. Base plate 16 is drilled to provide mounting holes 60 so that crusher 10 can be mounted on a bar, table, or the like, without detracting from its portability.

It is further important to note that the configuration of guides 24, which perform a guiding function with minimal actual contact on walls 52 and 28, is chosen so as to reduce friction losses by contact between guides 24 and the walls.

Inasmuch as the recent emphasis on recycling of non-renewable resources, particularly materials such as aluminum which require heavy energy consumption for manufacture, has created a substantial demand for otherwise wasted or scrap aluminum metal, including widespread national distribution of recycling facilities, it has become economically attractive for operators of establishments which generate empty aluminum beverage or other cans in quantity to collect and recover such containers for their scrap aluminum metal content. To achieve an economical program of collection, storage, and delivery of empty beverage cans, it is essential that the bulk of articles so collected in quantity be reduced, in order to save space, promote more efficient space planning for stock, and save on the cost of containers for storage of such articles. Crushing of cans with the method and device of the present invention achieves such volume reduction and does so at minimum labor and utility costs, inasmuch as cans can be crushed during working hours in a professional manner by, for instance, food establishment personnel, thereby reducing labor costs. Moreover, inasmuch as no electric parts are required to increase initial capital costs or operational costs, and inasmuch as only three moving parts are required, reducing maintenance costs to a minimum, the overall expense of operation of the present invention is low.

Further, it is to be noted that the economic values flowing from use of the invention can under appropriate circumstances create new employment possibilities, while at the same time reducing the volume of discarded materials which present a waste disposal problem in municipal refuse treatment operations, or even are carelessly introduced as litter into the environment to create esthetic and health problems caused by such littering.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A metal can crusher for deformably axially compressing a cylindrical metal can to a small fraction of its length comprising mounting means mounting the crusher and fixedly supporting an end of the cylindrical can and crushing means attached to the mounting means, said crushing means comprising a box assembly attached to the mounting means, a post assembly attached to the mounting means and box assembly, and movable handle means, the box assembly holding the metal can while the handle means exerts axial compressive force on the end of the can opposite the end of the can supported by the mounting means, anvil means for delivering said axial compressive force to the can, said handle means having a post pivot at one end thereof for pivotal connection to said post assembly, said post pivot being disposed above said anvil means, said handle further having a center post medially disposed between the ends of said handle, linking means comprising a substantially linear toggle pivotally connected at its upper end to said center post and pivotally connected at its lower end to said anvil means at an anvil pivot for converting manual rotational movement of said handle means to linear compressive movement of said anvil means, said center post describing a segment of a circular arc during axial compression of the cylindrical metal can, the arc being centered on the post pivot, said post pivot, center post, and anvil pivot forming an angle in a substantially vertical plane which includes said handle and said toggle defining the sides of an angle with the center post constituting the vertex of the angle, said angle increasing as said handle pivots downwardly about said post pivot and as said center post describes said arc during axial compression of the cylindrical metal can, said angle increasing to a straight angle upon maximum axial compression, whereby motion of the anvil means toward the mounting means axially compresses the can to said small fraction of its length and whereby maximum mechanical advantage is developable upon formation of said straight angle and whereby a snap is thence discernible in manual operation of the metal can crusher, said anvil means comprising a lug through which a pivot pin pivotally connects said lower end of said toggle to the anvil, said lug being removably attachable to said anvil and being characterised by a selectable distance from said anvil pivot to said anvil, whereby the position of the anvil when said straight angle is produced is selectable to permit control of said crushing fraction and to adapt the crusher to cans of a varying size.

2. The metal can crusher of claim 1 wherein said mounting means comprises a base plate to which the box assembly is fixedly attached, the base plate being adapted for substantially horizontally supporting the metal can crusher and mountable on a flat surface.

3. The metal can crusher of claim 2 wherein said anvil means comprises a substantially horizontal metal plate liftable by said movable means to permit insertion of said cylindrical metal can thereunder.

4. The metal can crusher of claim 3 wherein said post assembly comprises a vertical post mounted to said base plate, a horizontal arm attached to said vertical post and supporting said post pivot at its distal end, and a gusset supportingly reinforcing the connection between said arm and post, said box assembly comprising a side wall attached to said base plate and said vertical post, and a second side wall disposed oppositely of said first side wall and slotted for receiving said handle in pivotal motion thereof.

5. The metal can crusher of claim 4 wherein said anvil means further comprises a pair of guides substantially perpendicular to said side walls and mounted on the anvil, each of said guides having an upwardly projecting flange for guiding the anvil between the side walls during compression of the metal can.

6. The metal can crusher of claim 5 wherein said handle is angled, forming:

(a) a lever arm between said center post and post pivot; and (b) an upwardly angled gripping portion for convenient downward manual pivoting of the handle about the post pivot.

* * * * *